US012305661B2

(12) United States Patent
Zhang et al.

(10) Patent No.: US 12,305,661 B2
(45) Date of Patent: May 20, 2025

(54) SYSTEM AND METHOD OF SEALING COMPRESSOR

(71) Applicant: Solar Turbines Incorporated, San Diego, CA (US)

(72) Inventors: Donghui Zhang, San Diego, CA (US); Rainer Kurz, San Diego, CA (US); James Underwood, Chula Vista, CA (US); Jean-Luc Di Liberti, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 18/496,980

(22) Filed: Oct. 30, 2023

(65) Prior Publication Data

US 2025/0137463 A1 May 1, 2025

(51) Int. Cl.

*F04D 29/08* (2006.01)
*F04D 27/00* (2006.01)
*F04D 17/10* (2006.01)

(52) U.S. Cl.

CPC ..... *F04D 29/083* (2013.01); *F04D 27/001* (2013.01); *F04D 17/10* (2013.01)

(58) Field of Classification Search

CPC ..... F04D 29/083; F04D 27/001; F04D 17/10
USPC ..... 415/71–118
See application file for complete search history.

(56) References Cited

U.S. PATENT DOCUMENTS 2,306,951 A 12/1942 Jennings
3,390,830 A 7/1968 Kahane
6,887,034 B2 5/2005 Mesiter et al.
9,441,668 B2 * 9/2016 Devitt ..... F16C 33/748
9,726,194 B2 8/2017 Freeman et al.
2002/0084591 A1 7/2002 Akazawa et al.
2003/0063982 A1 * 4/2003 Pham ..... F04C 23/008 417/310
2003/0231954 A1 12/2003 Beccaluva et al.
2013/0327216 A1 * 12/2013 Deckman ..... B01D 53/047 96/113

(Continued)

FOREIGN PATENT DOCUMENTS

CN 206111603 U 4/2017
CN 104747463 B 5/2017
CN 112177950 B 12/2021

(Continued)

OTHER PUBLICATIONS

Written Opinion and International Search Report for Int'l. Patent Appln. No. PCT/US2024/048152, mailed Jan. 7, 2025 (22 pgs).

*Primary Examiner* — Shafiq Mian

(57) ABSTRACT

A system includes a compressor. The compressor has a center body and an end cap coupled to the center body at a connection interface. The system also includes a sealing system. The sealing system includes an annular duct circumferentially extending along a connection interface between the center body and the end cap. The sealing system also includes a conduit coupled to the annular duct. The system further includes a vacuum source in fluid communication with the annular duct via the conduit. In an operational state of the vacuum source, the vacuum source is configured to generate a vacuum in the annular duct to direct gases leaking through the connection interface in the annular duct.

23 Claims, 6 Drawing Sheets

(56) References Cited

U.S. PATENT DOCUMENTS

2015/0300366 A1* 10/2015 Freeman ..... F04D 17/125
415/203

FOREIGN PATENT DOCUMENTS

KR 20190009602 A 1/2019
WO 2010034602 A1 4/2010

* cited by examiner

SYSTEM AND METHOD OF SEALING COMPRESSOR

TECHNICAL FIELD

The present disclosure relates to a system including a compressor and a method of sealing the compressor.

BACKGROUND

A compressor, such as a centrifugal gas compressor, is a commonly used compression device that compresses a low-pressure gas into a high-pressure gas. The compressor includes one or more vanes or impellers that can be driven by a power source via a shaft that allows the compressor to compress various gases.

Typically, the compressor includes a body within which various components of the compressor are disposed. Further, one or more end caps are coupled to the body of the compressor to enclose the components and gases within the body. The end caps are disposed at both ends of the body. The compressor further includes a sealing member disposed between each end cap and the body to prevent leakage of gases through a gap between the end cap and the body. However, due to defects or deterioration of the sealing members, gases may leak through the gap and may be let into the atmosphere. Since the gases being compressed by the compressor may be flammable and/or toxic in nature, the leakage of such gases may lead to an undesirable increase in green-house effect and may also cause undesirable detonation and/or ignition or other undesirable issues.

CN112177950 discloses a circulating centrifugal gas compressor and relates to the technical field of compressors. The circulating centrifugal gas compressor comprises a gas compressor housing, a waterproof fixed base and a hollow telescopic housing, wherein the gas compressor housing and the hollow telescopic housing are both fixedly installed at the top of the waterproof fixed base; the gas compressor housing is located in the hollow telescopic housing; a lifting top plate is fixedly installed at the top of the hollow telescopic housing; a multi-cavity filter box is fixedly installed at the top of the lifting top plate; a water storage tank for telescopic adjustment is fixedly installed at one side of the waterproof fixing base; and a driving water pump is fixedly installed at the top of the water storage tank for telescopic adjustment. According to the invention, a vacuum cavity is formed, and a vacuum pump is matched for vacuumizing in advance before use, so that the purity of compressed gas is guaranteed; different gases can be filtered during compression by matching the multi-cavity filter box with the lifting top plate, so that more use requirements are met; and meanwhile, the hollow telescopic housing is arranged in a water pressure driving mode to achieve lifting, so that a better noise reduction effect is achieved.

SUMMARY OF THE DISCLOSURE

In an aspect of the present disclosure, a system is provided. The system includes a compressor. The compressor has a center body and an end cap coupled to the center body at a connection interface. The system also includes a sealing system. The sealing system includes an annular duct circumferentially extending along the connection interface between the center body and the end cap. The sealing system also includes a conduit coupled to the annular duct. The system further includes a vacuum source in fluid communication with the annular duct via the conduit. In an operational state of the vacuum source, the vacuum source is configured to generate a vacuum in the annular duct to direct gases leaking through the connection interface in the annular duct.

In another aspect of the present disclosure, a compressor is provided. The compressor includes a center body. The compressor also includes an end cap coupled to the center body at a connection interface. The compressor further includes a sealing system. The sealing system includes an annular duct circumferentially extending along the connection interface between the center body and the end cap. The sealing system also includes a conduit coupled to the annular duct. The sealing system further includes a vacuum source in fluid communication with the annular duct via the conduit. In an operational state of the vacuum source, the vacuum source is configured to generate a vacuum in the annular duct to direct gases leaking through the connection interface in the annular duct.

In yet another aspect of the present disclosure, a method of sealing a compressor is provided. The compressor has a center body and an end cap coupled to the center body at a connection interface. The method includes providing an annular duct. The annular duct circumferentially extends along the connection interface between the center body and the end cap. The method also includes connecting a conduit with the annular duct. The method further includes connecting, fluidly, a vacuum source with the annular duct via the conduit. The method includes operating the vacuum source in an operational state. The method also includes generating a vacuum in the annular duct based on the operation of the vacuum source in the operational state. The method further includes directing gases leaking through the connection interface in the annular duct based on the generation of the vacuum in the annular duct.

In yet another aspect of the present disclosure, a sealing system for a compressor is provided. The compressor has a center body and an end cap coupled to the center body at a connection interface. The sealing system includes an annular duct configured to circumferentially extend along the connection interface between the center body and the end cap. The sealing system also includes a conduit coupled to the annular duct.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
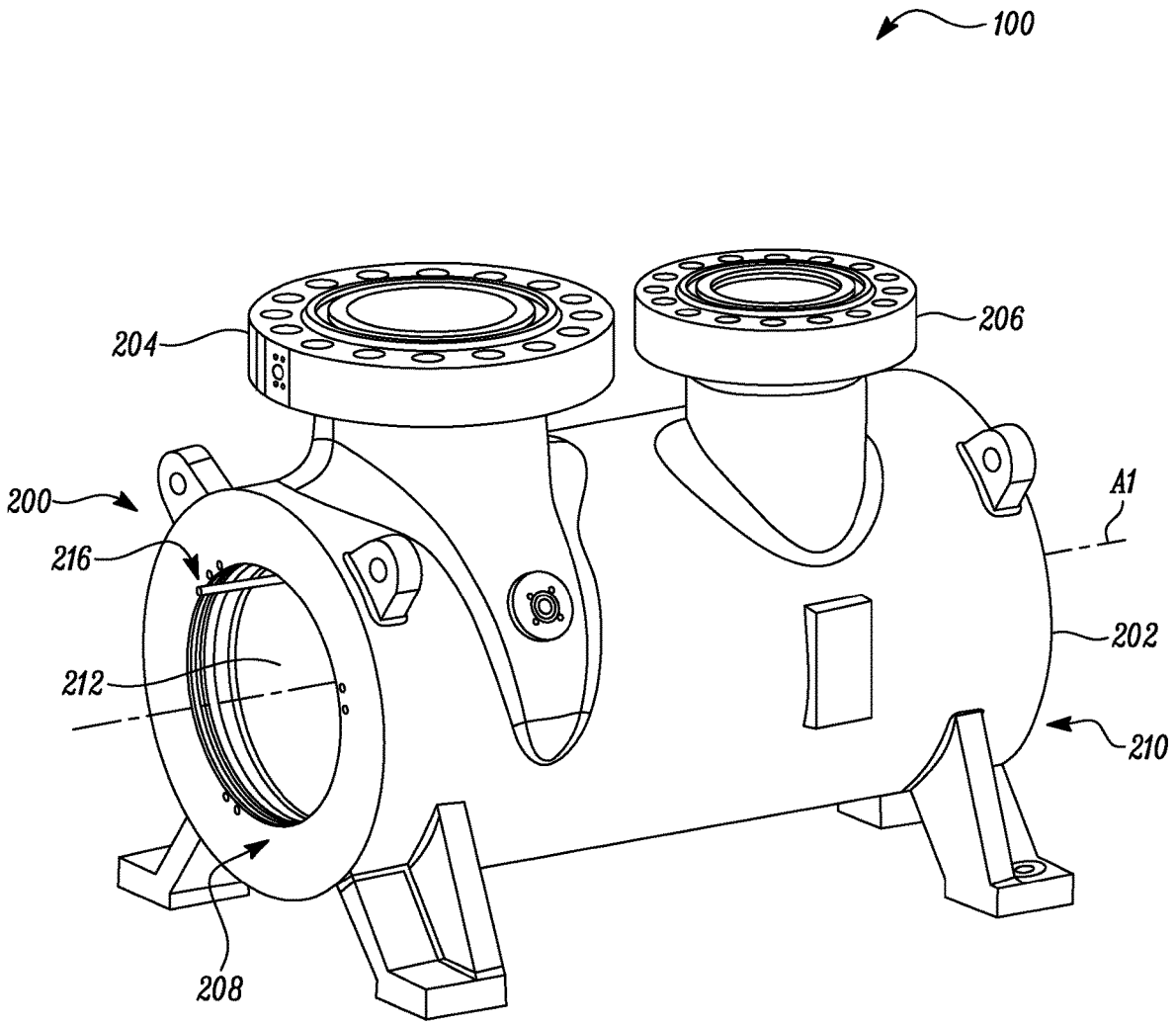
FIG. 1 is a schematic perspective view of a system including a compressor, according to an example of the present disclosure.

Referring to FIG. 1, a schematic perspective view of a system 100 is illustrated. The system 100 includes a compressor 200. The compressor 200 includes a center body 202. The compressor 200 defines a central axis A1. The center body 202 extends along the central axis A1 and forms a hollow interior. The compressor 200 also defines a first end 208 and a second end 210 opposite the first end 208.

The center body 202 includes a suction port 204 and a discharge port 206. Each of the suction port 204 and the discharge port 206 are spaced apart from the first end 208 and the second end 210, respectively. Gases to be compressed may enter the compressor 200 via the suction port 204. The compressor 200 further includes one or more impellers (not shown) disposed inside the center body 202. The impellers may be connected to a power source (not shown) via a shaft (not shown) that imparts rotation to the impellers. The gases entering through the suction port 204 are compressed by the impellers. The compressed gases exit the compressor 200 through the discharge port 206 of the center body 202. In some examples, the gases may include ammonia gases, propylene, natural gases, rich petroleum gases, carbon monoxide, methanol, ethylene, hydrogen, and the like.

It should be noted that the compressor 200 may be used in industrial production and equipment preparation processes, such as an oil refining and chemical system, a refrigeration system, a fuel cell engine, a gas turbine engine, a wastewater treatment station, a factory gas station, a laboratory gas supply, and the like. The compressor 200 may be embodied as a centrifugal gas compressor that may compress low pressure gases into high pressure gases. Alternatively, the compressor 200 may be embodied as an axial compressor, or any other type of compressor. In some examples, the compressor 200 may have one or more stages of compression for improving a pressure ratio of compression. For example, the compressor 200 may include a double-stage compressor that may be formed by connecting two single-stage compressors in series and may be used for improving the pressure ratio of compression.

Figure 2:
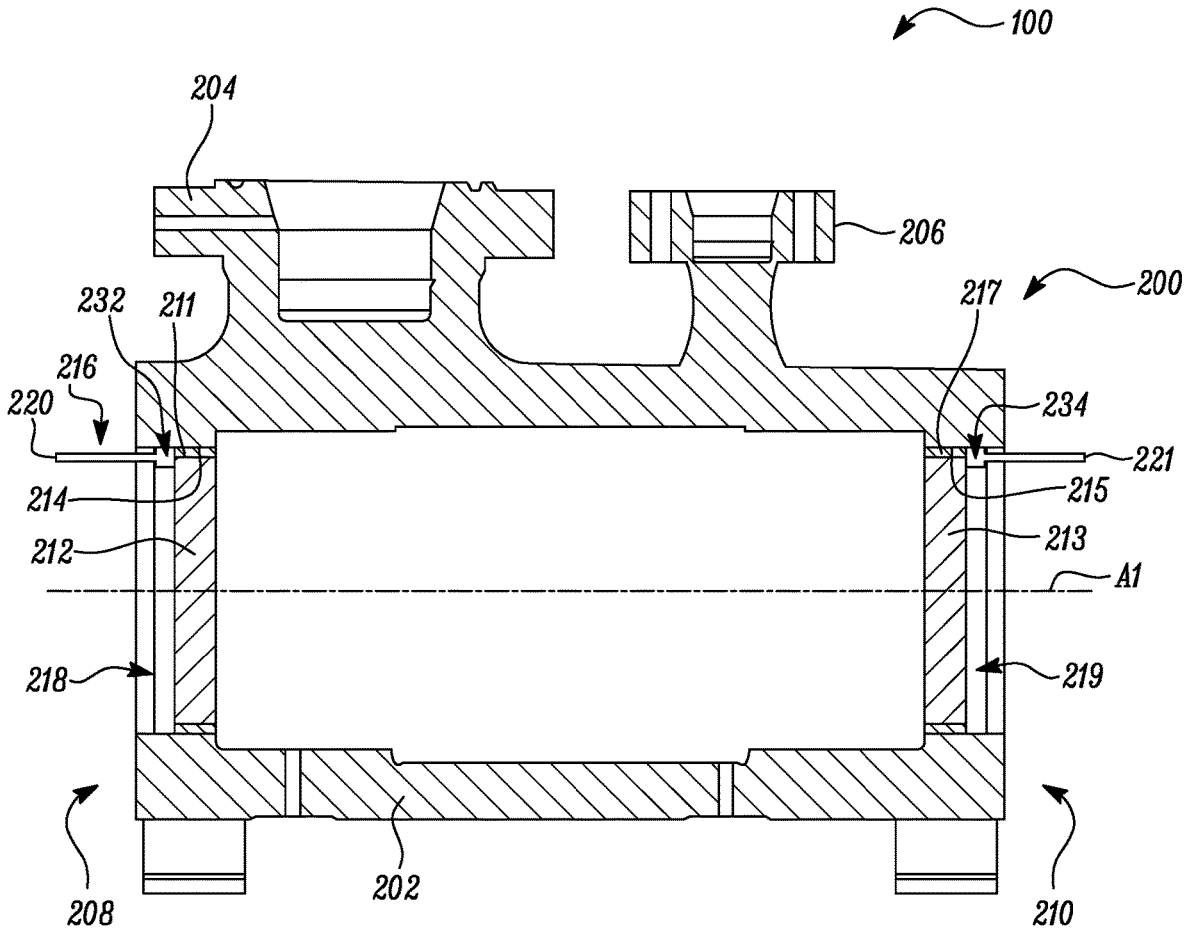
FIG. 2 is a sectional side view of the compressor of FIG. 1.

FIG. 2 is a sectional side view of the compressor 200 associated with the system 100 of FIG. 1. The compressor 200 includes an end cap 212, 213 coupled to the center body 202 at a connection interface 214, 215, respectively. The end cap 212, 213 may be disposed at least partially within the center body 202. It should be noted that the compressor 200 includes two end caps 212, 213 herein. Particularly, one end cap 212 is disposed at the first end 208 and another end cap 213 is disposed at the second end 210 of the compressor 200. In some examples, the end caps 212, 213 may be coupled to the center body 202 at the corresponding connection interface 214, 215 via one or more fastening elements (not shown). In some examples, the fastening elements may include a bolt, a screw, a rivet, or the like. In some examples, the end caps 212, 213 may be made of a metallic material, a polymeric material or a combination of both.

Further, a sealing member 211, 217 may be disposed between the center body 202 and the corresponding end cap 212, 213 and to seal the connection interface 214, 215. The sealing members 211, 217 may prevent leakage of gases into the atmosphere, via the connection interface 214, 215. However, in some cases, due to defects or deterioration of the sealing members 211, 217, gases may leak through the connection interface 214, 215 and may be let into the atmosphere. Since the gases being compressed by the compressor 200 may be flammable and/or toxic in nature, the leakage of such gases may lead to an undesirable increase in green-house effect and there may be a possibility of undesirable ignition or other undesirable issues.

Thus, the present disclosure relates to a sealing system 216 that seals and captures the gases leaking/slipping through the connection interface 214, 215 and/or the sealing members 211, 217. Specifically, the compressor 200 includes the sealing system 216. The sealing system 216 includes an annular duct 218, 219 circumferentially extending along the connection interface 214, 215 between the center body 202 and the end cap 212, 213, respectively. The annular duct 218, 219 is concentrically disposed along a periphery of the end cap 212, 213 of the compressor 200 in relation to the central axis A1 of the compressor 200. In the illustrated example of FIG. 2, the annular duct 218 is disposed at the first end 208 of the compressor 200 and the annular duct 219 is disposed at the second end 210 of the compressor 200.

Figure 3:
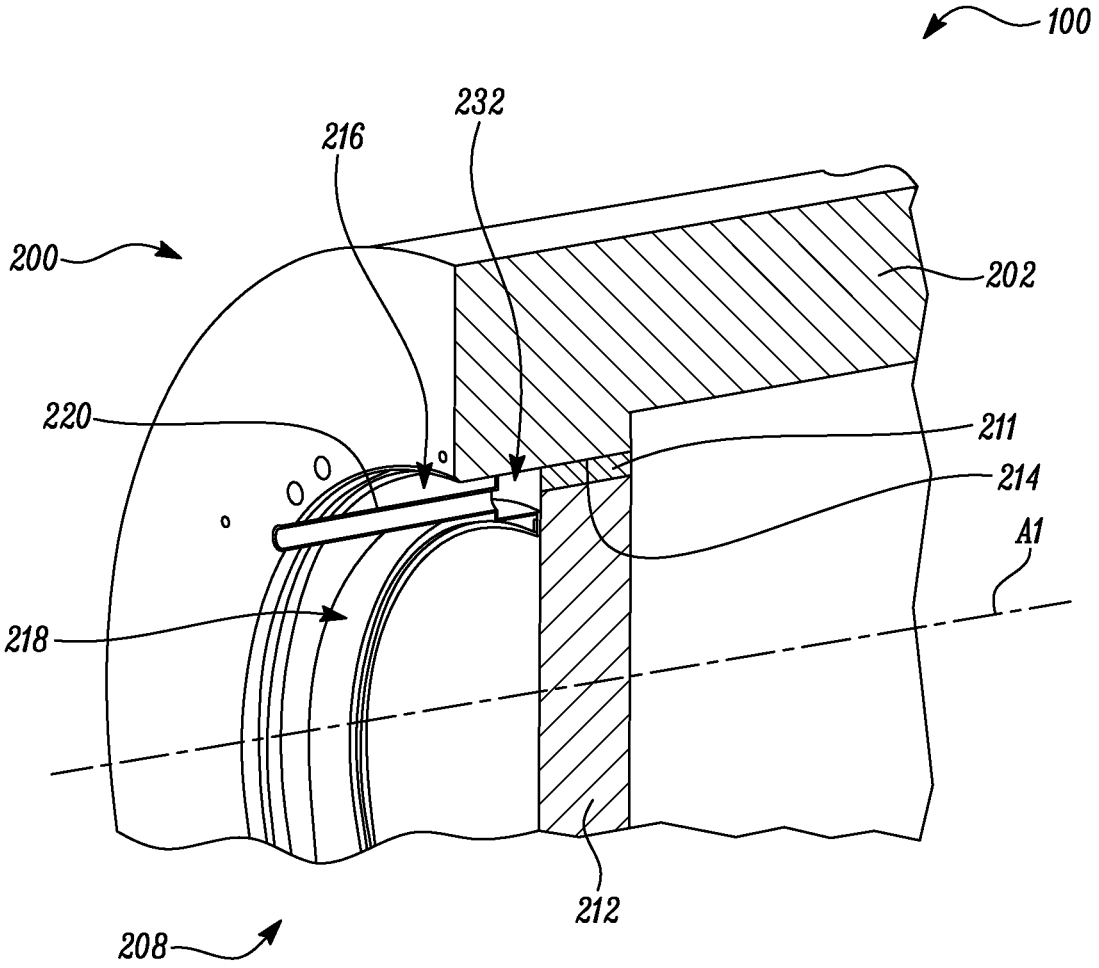
FIG. 3 is a sectional perspective front and side view of a portion of the compressor of FIG. 2.

Referring to FIG. 3, a perspective sectional front and side view of a portion of the compressor 200 is illustrated. As shown in FIGS. 2 and 3, the annular duct 218 defines a chamber 232. The chamber 232 is in fluid communication with the connection interface 214 and captures any gases leaking through the connection interface 214 therein.

Referring again to FIG. 2, the annular duct 219 defines a chamber 234. The chamber 234 is in fluid communication with the connection interface 215 and captures any gases leaking through the connection interface 215 therein.

Further, the sealing system 216 also includes a conduit 220, 221 coupled to the annular duct 218, 219. Specifically, the conduit 220 is coupled to the annular duct 218 at the first end 208 of the compressor 200 and the conduit 221 is coupled to the annular duct 219 at the second end 210 of the compressor 200. The conduit 220, 221 may be fixedly coupled or removably coupled to the corresponding annular duct 218, 219, as per application requirements. The conduit 220, 221 may be coupled to the corresponding annular duct 218, 219 via one or more fastening elements or the conduit 220, 221 may be coupled to the corresponding annular duct 218, 219 via a threaded arrangement. In some examples, the fastening elements may include a bolt, a screw, a rivet, or the like. In other examples, the conduit 220, 221 may be coupled to the corresponding annular duct 218, 219 via welding, brazing, soldering, and the like.

Figure 4:
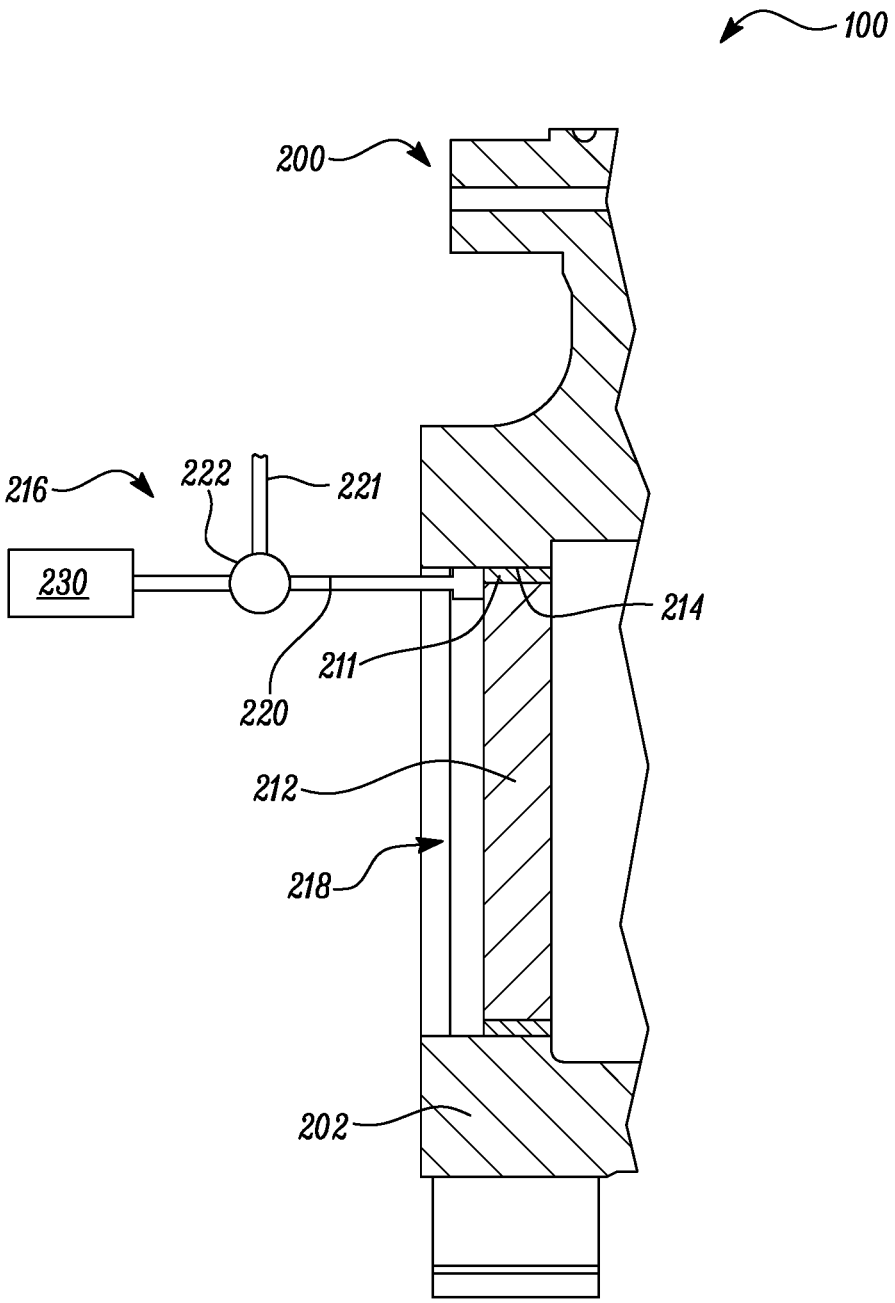
FIG. 4 is a schematic view illustrating a sealing system and a portion of the compressor of FIG. 2, according to an example of the present disclosure.

Referring to FIG. 4, a schematic view of the sealing system 216 and a portion of the compressor 200 is illustrated. The sealing system 216 further includes a vacuum source 222. The vacuum source 222 is in fluid communication with the annular duct 218, 219 (see FIG. 2) via the conduit 220, 221. In some examples, the vacuum source 222 is a vacuum pump. The vacuum pump may include any conventional pump that can generate vacuum. In an operational state of the vacuum source 222, the vacuum source 222 generates a vacuum in the annular duct 218, 219 to direct gases leaking through the connection interface 214, 215 (see FIG. 2) in the annular duct 218, 219. Further, the vacuum source 222 may also be in fluid communication with other low pressure leakage sources (not shown) of the compressor 200. Accordingly, the vacuum generated by the vacuum source 222 may allow receipt of gases leaking through other low pressure leakage sources of the compressor 200. The vacuum source 222 may operate in the operational state when the compressor 200 is in operation.

Figure 5:
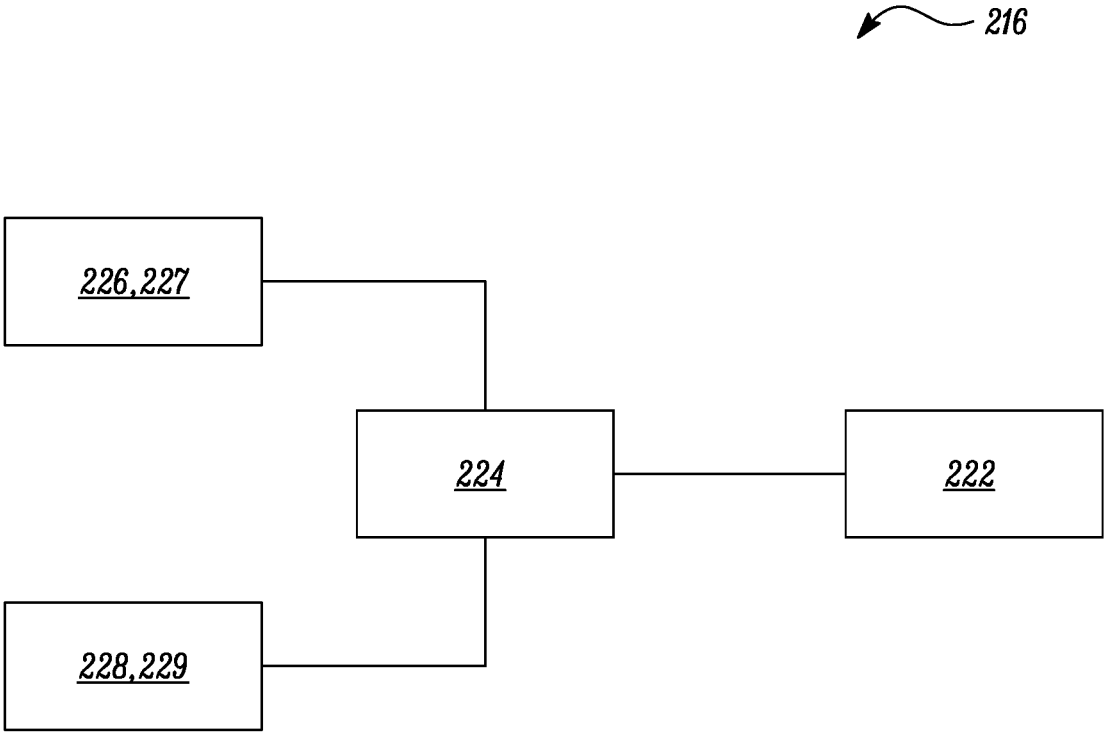
FIG. 5 is a block diagram of the sealing system of FIG. 4.

Referring to FIG. 5, the sealing system 216 also includes a controller 224. The controller 224 controls an operation of the vacuum source 222 to maintain a predetermined amount of vacuum in the annular duct 218, 219 (see FIG. 2).

The sealing system 216 further includes a pressure sensor 226, 227 in fluid communication with the annular duct 218, 219, respectively. In the illustrated example of FIG. 5, the pressure sensor 226 is disposed in the annular duct 218 and the pressure sensor 227 is disposed in the annular duct 219. The pressure sensor 226, 227 determines a real-time pressure in the annular duct 218, 219, respectively. Specifically, the pressure sensor 226 determines the real-time pressure in the annular duct 218. The pressure sensor 227 determines the real-time pressure in the annular duct 219. In some examples, the pressure sensors 226, 227 may include a potentiometric pressure sensor, an inductive pressure sensor, a capacitive pressure sensor, a piezoelectric pressure sensor, a strain gauge pressure sensor, or a variable reluctance pressure sensor. The present disclosure is not limited by a type of the pressure sensor 226, 227.

The controller 224 receives a value of the real-time pressure in the annular duct 218, 219 from the pressure sensor 226, 227. The controller 224 further controls the operation of the vacuum source 222 to maintain the predetermined amount of vacuum in the annular duct 218, 219 based on the value of the real-time pressure received from the pressure sensor 226, 227. In some examples, the controller 224 may compare the real-time pressure in the annular duct 218, 219 with a value of the predetermined amount of vacuum that is required to be maintained in the annular duct 218, 219. If the real-time pressure in the annular duct 218, 219 is less than the value of the predetermined amount of vacuum, the controller 224 may control the vacuum source 222 so that the real-time pressure corresponds to the value of the predetermined amount of vacuum.

The sealing system 216 also includes a gas detection sensor 228, 229 in fluid communication with the annular duct 218, 219, respectively. In the illustrated example of FIG. 5, the gas detection sensor 228 is disposed in the annular duct 218 and the gas detection sensor 229 is disposed in the annular duct 219. The gas detection sensor 228, 229 determines a presence of gas in the annular duct 218, 219, respectively. In some examples, the gas detection sensors 228, 229 may include an electrochemical sensor, a catalytic sensor, an infrared sensor or a photoionization sensor. The present disclosure is not limited by a type of the gas detection sensor 228, 229.

The controller 224 receives an indication of the presence of gas in the annular duct 218, 219 from the gas detection sensor 228, 229. The controller 224 further controls the operation of the vacuum source 222 based on the presence of gas detected by the gas detection sensor 228, 229. In some examples, the gas detection sensor 228, 229 may detect a volume/a concentration of gas within the in the annular duct 218, 219. In such examples, if the controller 224 determines an increased volume of gases in the annular duct 218, 219, the controller 224 may operate the vacuum source 222 at an increased rate to handle the increased volume of gases.

The controller 224 may be a control circuit, a computer, a microprocessor, a microcomputer, a central processing unit, or any suitable device or apparatus. The controller 224 may include one or more memories and one or more processors. The one or more processors may be communicably coupled with the one or more memories. The one or more memories may store the value of the predetermined amount of vacuum therein. In some examples, an operator of the compressor 200 may have remote access to the controller 224 to control an operation of the sealing system 216. For example, the operator may provide manual inputs to the controller 224 to operate the vacuum source 222 at a desired rate and/or configuration.

Referring again to FIG. 4, the sealing system 216 further includes a collection chamber 230 that is in fluid communication with the annular duct 218, 219 (see FIG. 2) via the conduit 220, 221. Specifically, the collection chamber 230 is in fluid communication with the annular duct 218 via the conduit 220. The collection chamber 230 is in fluid communication with the annular duct 219 via the conduit 221. When the vacuum source 222 is in the operational state, the gases collected in the annular duct 218, 219 are further directed towards the collecting chamber 230. The collecting chamber 230 may collect and store the gases.

In some examples, the collection chamber 230 may recirculate the gases back into the compressor 200 (see FIG. 1) via the suction port 204 (see FIG. 1). In an example, the gases collected in the collection chamber 230 may be used for analysis to determine one or more characteristics of the gases. In another example, the collection chamber 230 may be in fluid communication with a flare system (not shown). In such an example, the gases collected in the collection chamber 230 may be directed towards the flare system.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure is directed towards the sealing system 216 for the compressor 200. The sealing system 216 includes the annular duct 218, 219 that receives the gases leaking via the connection interface 214, 215 of the compressor 200, based on the generation of the vacuum by the vacuum source 222. The sealing system 216 further directs the gases collected in the annular duct 218, 219 into the collection chamber 230, thereby preventing leakage of gases into the atmosphere that may otherwise lead to an undesirable increase in green-house effect or may cause undesirable ignition or other unwanted consequences.

The sealing system 216 described herein is simple in construction and cost-effective. Further, the sealing system 216 may be coupled to the compressor 200 in a time-efficient manner without requiring costly set-ups or high operator expertise. Furthermore, the sealing system 216 may be coupled to various types of compressors. The sealing system 216 may be retrofitted on existing compressors.

Figure 6:
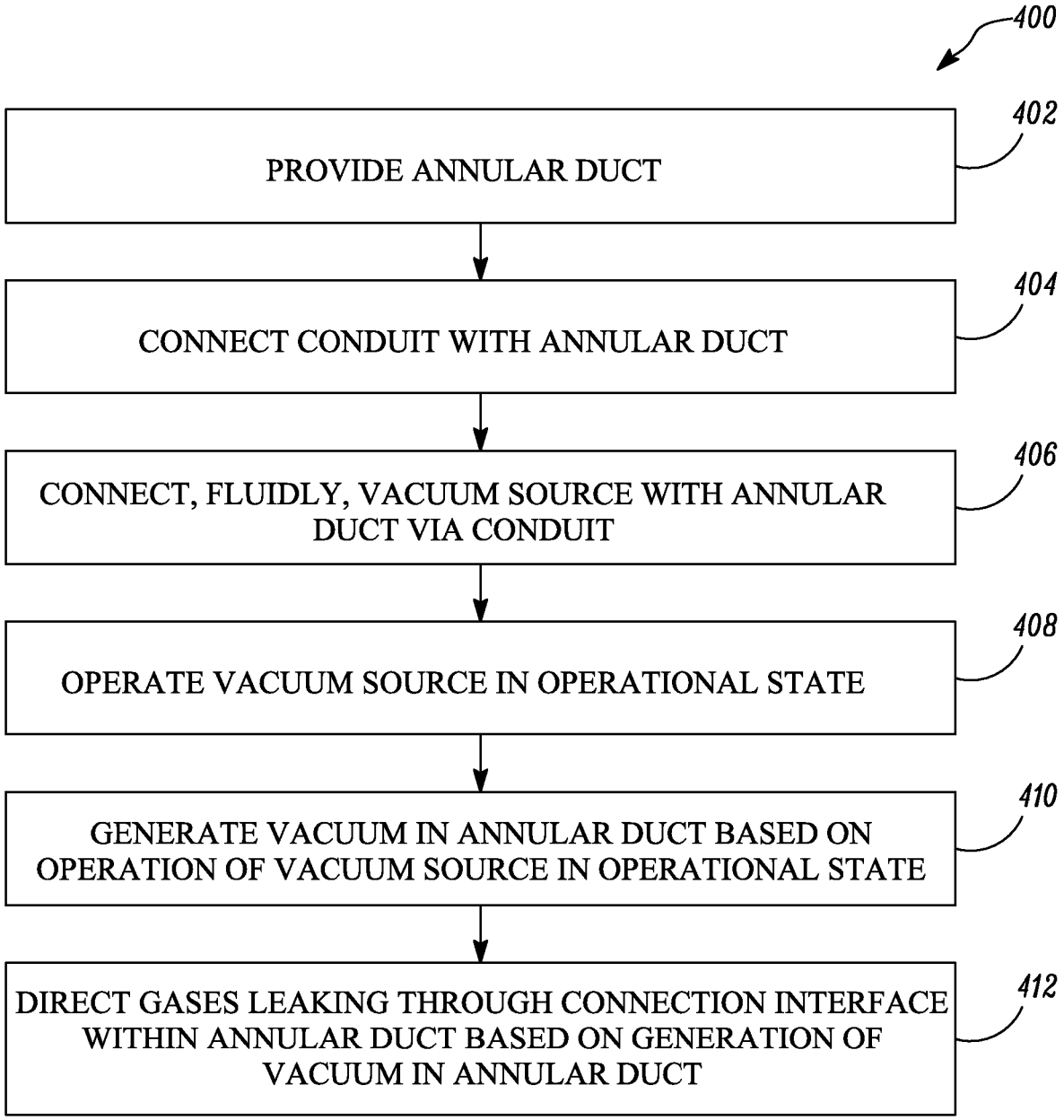
FIG. 6 is a flowchart for a method of sealing the compressor of FIG. 1, according to an example of the present disclosure.

FIG. 6 is a flowchart for a method 400 of sealing the compressor 200 of FIG. 1. With reference to FIGS. 1 to 6, at step 402, the annular duct 218, 219 is provided. The annular duct 218, 219 circumferentially extends along the connection interface 214, 215 between the center body 202 and the end cap 212, 213. At step 404, the conduit 220, 221 is connected with the annular duct 218, 219. At step 406, the vacuum source 222 is fluidly connected with the annular duct 218, 219 via the conduit 220, 221. At step 408, the vacuum source 222 is operated in the operational state. At step 410, the vacuum is generated in the annular duct 218, 219 based on the operation of the vacuum source 222 in the operational state.

At step 412, gases leaking through the connection interface 214, 215 are directed in the annular duct 218, 219 based on the generation of the vacuum in the annular duct 218, 219. The method 400 further includes a step (not shown) at which the gases collected in the annular duct 218, 219 are directed towards the collection chamber 230 based on the operation of the vacuum source 222 in the operational state. The collection chamber 230 is in fluid communication with the annular duct 218, 219 via the conduit 220, 221.

The method 400 also includes a step (not shown) at which the operation of the vacuum source 222 is controlled by the controller 224 to maintain the predetermined amount of vacuum in the annular duct 218, 219.

The method 400 includes a step (not shown) at which the real-time pressure in the annular duct 218, 219 is detected by the pressure sensor 226, 227 in fluid communication with the annular duct 218, 219. The method 400 also includes a step (not shown) at which the value of the real-time pressure in the annular duct 218, 219 is received by the controller 224 from the pressure sensor 226, 227. The method 400 further includes a step (not shown) at which the operation of the vacuum source 222 is controlled by the controller 224 to maintain the predetermined amount of vacuum in the annular duct 218, 219, based on the value of the real-time pressure received from the pressure sensor 226, 227.

The method 400 includes a step (not shown) at which the presence of gas in the annular duct 218, 219 is detected by the gas detection sensor 228, 229 in fluid communication with the annular duct 218, 219. The method 400 also includes a step (not shown) at which the indication of the presence of gas in the annular duct 218, 219 is received by the controller 224 from the gas detection sensor 228, 229. The method 400 also includes a step (not shown) at which the operation of the vacuum source 222 is controlled by the controller 224, based on the presence of gas detected by the gas detection sensor 228, 229.

It may be desirable to perform one or more of the steps shown in FIG. 6, and/or described above, in an order different from that depicted and/or described. One or more of the steps shown in FIG. 6, and/or described above, could be omitted. Furthermore, various steps could be performed together.

Unless explicitly excluded, the use of the singular to describe a component, structure, or operation does not exclude the use of plural such components, structures, or operations or their equivalents. The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B; A, A and B; A, B and B), unless otherwise indicated herein or clearly contradicted by context. Similarly, as used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

While aspects of the present disclosure have been particularly shown and described with reference to the embodiments above, it will be understood by those skilled in the art that various additional embodiments may be contemplated by the modification of the disclosed work machine, systems and methods without departing from the spirit and scope of the disclosure. Such embodiments should be understood to fall within the scope of the present disclosure as determined based upon the claims and any equivalents thereof.

What is claimed is:

1. A system, comprising:

a compressor, the compressor having a center body and an end cap coupled to the center body at a connection interface; and a sealing system comprising:

an annular duct circumferentially extending along the connection interface between the center body and the end cap;

a conduit coupled to the annular duct; and a vacuum source in fluid communication with the annular duct via the conduit, wherein, in an operational state of the vacuum source, the vacuum source is configured to generate a vacuum in the annular duct to direct gases leaking through the connection interface in the annular duct.

2. The system of claim 1, further comprising: a controller configured to control an operation of the vacuum source to maintain a predetermined amount of vacuum in the annular duct.

3. The system of claim 2, further comprising:

a pressure sensor in fluid communication with the annular duct to determine a real-time pressure in the annular duct, and wherein the controller is configured to:

receive a value of the real-time pressure in the annular duct from the pressure sensor; and control the operation of the vacuum source to maintain the predetermined amount of vacuum in the annular duct based on the value of the real-time pressure received from the pressure sensor.

4. The system of claim 2, further comprising:

a gas detection sensor in fluid communication with the annular duct, the gas detection sensor being configured to determine a presence of gas in the annular duct, and wherein the controller is configured to:

receive an indication of the presence of gas in the annular duct from the gas detection sensor; and control the operation of the vacuum source based on the presence of gas detected by the gas detection sensor.

5. The system of claim 1, further comprising:

a collection chamber that is in fluid communication with the annular duct via the conduit, wherein, when the vacuum source is configured in the operational state, the gases collected within the annular duct are further directed towards the collecting chamber.

6. The system of claim 1, wherein the annular duct is concentrically disposed along a periphery of the end cap of the compressor in relation to a central axis of the compressor.

7. The system of claim 1, wherein the vacuum source is a vacuum pump.

8. A compressor comprising:

a center body;

an end cap coupled to the center body at a connection interface; and a sealing system including:

an annular duct circumferentially extending along the connection interface between the center body and the end cap;

a conduit coupled to the annular duct; and a vacuum source in fluid communication with the annular duct via the conduit, wherein, in an operational state of the vacuum source, the vacuum source is configured to generate a vacuum in the annular duct to receive gases leaking through the connection interface in the annular duct.

9. The compressor of claim 8, wherein the sealing system further includes a controller configured to control an operation of the vacuum source to maintain a predetermined amount of vacuum in the annular duct.

10. The compressor of claim 9, wherein the sealing system further includes a pressure sensor in fluid communication with the annular duct to determine a real-time pressure in the annular duct, and wherein the controller is configured to:

receive a value of the real-time pressure in the annular duct from the pressure sensor; and control the operation of the vacuum source to maintain the predetermined amount of vacuum in the annular duct based on the value of the real-time pressure received from the pressure sensor.

11. The compressor of claim 9, wherein the sealing system further includes a gas detection sensor in fluid communication with the annular duct to determine a presence of gas in the annular duct, and wherein the controller is configured to:

receive an indication of the presence of gas in the annular duct from the gas detection sensor; and control the operation of the vacuum source based on the presence of gas detected by the gas detection sensor.

12. The compressor of claim 8, wherein the vacuum source is disposed in the conduit.

13. The compressor of claim 8, wherein the sealing system includes a collection chamber that is in fluid communication with the annular duct via the conduit, and wherein, in the operational state of the vacuum source, the gases collected within the annular duct are further directed towards the collecting chamber.

14. The compressor of claim 8, wherein the annular duct is concentrically disposed along a periphery of the end cap of the compressor in relation to a central axis of the compressor.

15. The compressor of claim 8, wherein the vacuum source is a vacuum pump.

16. A method of sealing a compressor, the compressor having a center body and an end cap coupled to the center body at a connection interface, the method comprising:

providing an annular duct, wherein the annular duct circumferentially extends along the connection interface between the center body and the end cap;

connecting a conduit with the annular duct;

connecting, fluidly, a vacuum source with the annular duct via the conduit;

operating the vacuum source in an operational state;

generating a vacuum in the annular duct based on the operation of the vacuum source in the operational state; and receiving gases leaking through the connection interface in the annular duct based on the generation of the vacuum in the annular duct.

17. The method of claim 16, further comprising controlling, by a controller, an operation of the vacuum source to maintain a predetermined amount of vacuum in the annular duct.

18. The method of claim 17, further comprising:

detecting, by a pressure sensor in fluid communication with the annular duct, a real-time pressure in the annular duct;

receiving, by the controller, a value of the real-time pressure in the annular duct from the pressure sensor; and controlling, by the controller, the operation of the vacuum source to maintain the predetermined amount of vacuum in the annular duct based on the value of the real-time pressure received from the pressure sensor.

19. The method of claim 17, further comprising:

detecting, by a gas detection sensor in fluid communication with the annular duct, a presence of gas in the annular duct;

receiving, by the controller, an indication of the presence of gas in the annular duct from the gas detection sensor; and controlling, by the controller, the operation of the vacuum source based on the presence of gas detected by the gas detection sensor.

20. The method of claim 16, further comprising directing, based on the operation of the vacuum source in the operational state, the gases collected within the annular duct towards a collecting chamber, wherein the collection chamber is in fluid communication with the annular duct via the conduit.

21. A sealing system for a compressor, the compressor having a center body and an end cap coupled to the center body at a connection interface, the sealing system comprising:

an annular duct configured to circumferentially extend along the connection interface between the center body and the end cap; and a conduit coupled to the annular duct;

wherein the annular duct is configured to be concentrically disposed along a periphery of the end cap of the compressor in relation to a central axis of the compressor.

22. The sealing system of claim 21, further comprising:

a vacuum source in fluid communication with the annular duct via the conduit, wherein, in an operational state of the vacuum source, the vacuum source is configured to generate a vacuum in the annular duct to receive gases leaking through the connection interface in the annular duct; and a controller configured to control an operation of the vacuum source to maintain a predetermined amount of vacuum in the annular duct.

23. The sealing system of claim 22, further comprising:

a collection chamber in fluid communication with the annular duct via the conduit, wherein, when the vacuum source is configured in the operational state, the gases collected within the annular duct are further directed towards the collecting chamber.

* * * * *